US011084284B2

(12) United States Patent
Mizuno

(10) Patent No.: US 11,084,284 B2
(45) Date of Patent: Aug. 10, 2021

(54) LIQUID EJECTION HEAD

(71) Applicant: Brother Kogyo Kabushiki Kaisha, Nagoya (JP)

(72) Inventor: Taisuke Mizuno, Yokkaichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/828,140

(22) Filed: Mar. 24, 2020

(65) Prior Publication Data

US 2020/0307209 A1 Oct. 1, 2020

(30) Foreign Application Priority Data

Apr. 1, 2019 (JP) ..... JP2019-069604

(51) Int. Cl.
*B41J 2/14* (2006.01)

(52) U.S. Cl.
CPC .. *B41J 2/14201* (2013.01); *B41J 2002/14419* (2013.01)

(58) Field of Classification Search
CPC ..... B41J 2/14201; B41J 2002/14419; B41J 2002/14241; B41J 2/14233; B41J 2202/12
See application file for complete search history.

(56) References Cited

U.S. PATENT DOCUMENTS

2018/0281407 A1* 10/2018 Hayashi ..... B41J 2/04581

FOREIGN PATENT DOCUMENTS

JP 2015-101034 A 6/2015

OTHER PUBLICATIONS

IP.com search (Year: 2021).*

* cited by examiner

*Primary Examiner* — Lisa Solomon
(74) *Attorney, Agent, or Firm* — Banner & Witcoff, Ltd.

(57) ABSTRACT

A liquid ejection head includes an array of first nozzle holes, an array of second nozzle holes, first pressure chambers to which an ejection pressure is applied for liquid ejection from the first nozzle holes, second pressure chambers to which an ejection pressure is applied for liquid ejection from the second nozzle holes, and a manifold. The manifold includes a first channel communicating with the first pressure chambers, a first opening located at the first channel and through which liquid enters from an exterior, a second channel communicating with the second pressure chambers, a second opening located at the second channel and through which liquid exits to the exterior, a first communication passage communicating one end of the first channel with one end of the second channel, and a second communication passage communicating the other end of the first channel with the other end of the second channel.

16 Claims, 11 Drawing Sheets

LIQUID EJECTION HEAD

CROSS-REFERENCE TO RELATED APPLICATION

This application claims priority from Japanese Patent Application No. 2019-069604 filed on Apr. 1, 2019, the content of which is incorporated herein by reference in its entirety.

TECHNICAL FIELD

Aspects of the disclosure relate to a liquid ejection head.

BACKGROUND

A known liquid ejection head includes nozzles for liquid ejection, pressure generating chambers communicating with the nozzles, a manifold communicating with the pressure generating chambers, an inflow passage through which liquid is supplied from a tank at an exterior of the liquid ejection head to the manifold, and an outflow passage through which liquid exits from the manifold toward the tank. The inflow passage and the outflow passage are respectively located on one side and the other side of the manifold which extends in a first direction.

SUMMARY

In the known liquid ejection head, when liquid flows from the inflow passage, via the manifold, to the outflow passage, components, such as pigments, contained in the liquid may settle, causing differences in concentration of the liquid in the first direction.

Aspects of the disclosure provide a liquid ejection head configured to reduce differences in liquid concentration.

According to one or more aspects of the disclosure, a liquid ejection head includes a first nozzle hole array, a second nozzle hole array, a plurality of first pressure chambers, a plurality of second pressure chambers, and a manifold. The first nozzle hole array includes a plurality of first nozzle holes arranged in a first direction. The second nozzle hole array is spaced from the first nozzle hole array in a second direction crossing the first direction, and includes a plurality of second nozzle holes arranged in the first direction. An ejection pressure is applied to the plurality of first pressure chambers for liquid ejection from the first nozzle holes. An ejection pressure is applied to the plurality of second pressure chambers for liquid ejection from the second nozzle holes. The manifold communicates with the plurality of first pressure chambers and the plurality of second pressure chambers. The manifold includes a first channel communicating with the plurality of first pressure chambers, a first opening which is located at the first channel and through which liquid enters from an exterior, a second channel communicating with the plurality of second pressure chambers, a second opening which is located at the second channel and through which liquid exits to the exterior, a first communication passage communicating one end of the first channel with one end of the second channel, and a second communication passage communicating the other end of the first channel with the other end of the second channel.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Illustrative embodiments of the disclosure will be described with reference to the drawings.

First Illustrative Embodiment

<Structure of Liquid Ejection Apparatus>

A liquid ejection apparatus 10 including a liquid ejection head 20 (hereinafter referred to as a "head") according to a first illustrative embodiment is configured to eject liquid. Hereinafter, the liquid ejection apparatus 10 will be described by way of example as applied to, but not limited to, an inkjet printer.

Figure 1:
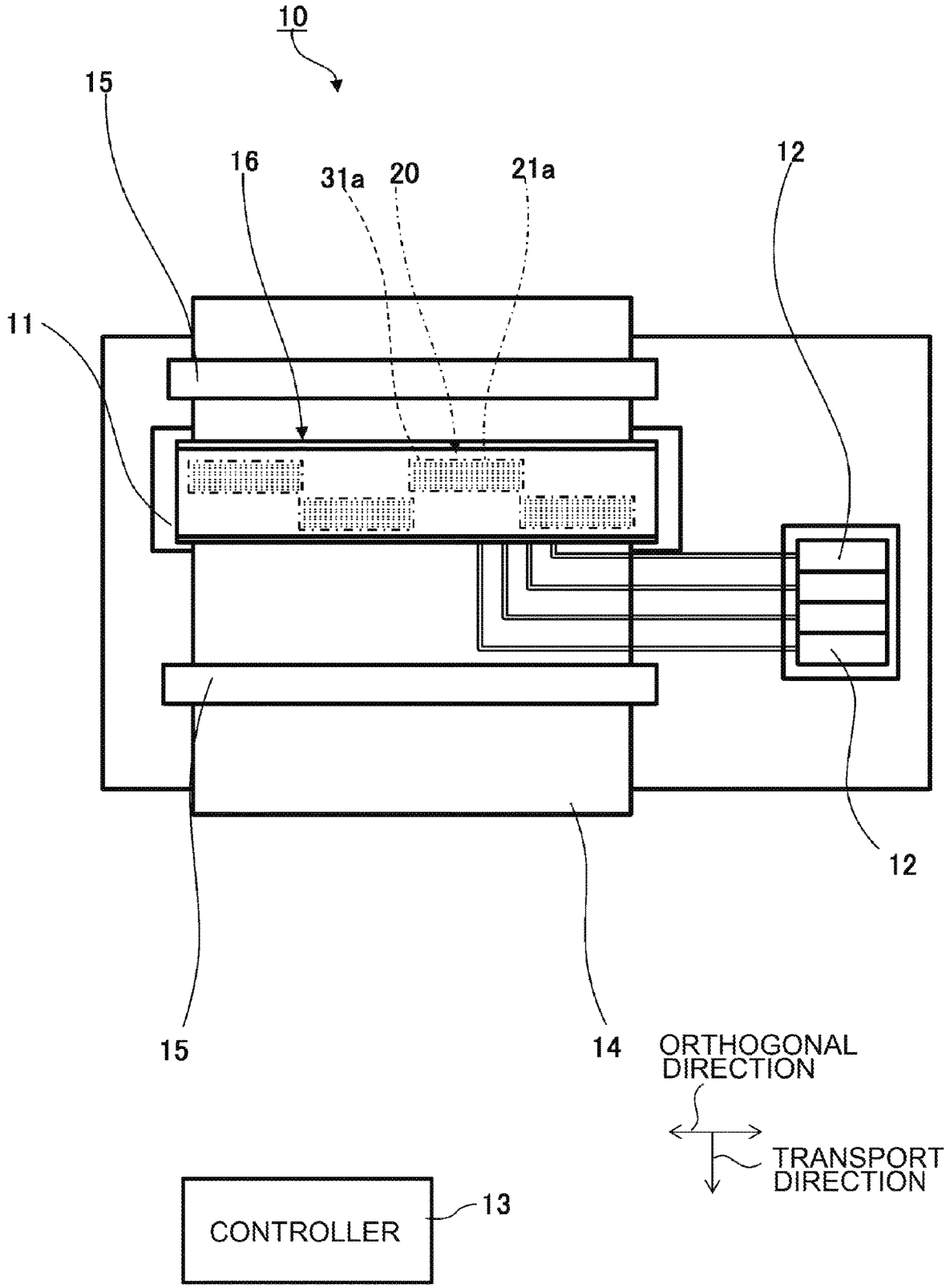
FIG. 1 is a schematic diagram of a liquid ejection apparatus including a liquid ejection head according to a first illustrative embodiment.

As shown in FIG. 1, the liquid ejection apparatus 10 employs a line head type and includes a platen 11, a transport unit, a head unit 16, tanks 12, and a controller 13. The liquid ejection apparatus 10 may employ a serial head type or other types than the line head type.

The platen 11 is a flat plate member to receive thereon a sheet 14 and adjust a distance between the sheet 14 and the head unit 16. Herein, one side of the platen 11 toward the head unit 16 is referred to as an upper side, and the other side of the platen 11 away from the head unit 16 is referred to as a lower side. However, the liquid ejection apparatus 10 may be positioned in other orientations.

The transport unit may include two transport rollers 15 and a transport motor (not shown). The two transport rollers 15 are disposed parallel to each other while interposing the platen 11 therebetween in a transport direction, and are connected to the transport motor. When the transport motor is driven, the transport rollers 15 rotate to transport the sheet 14 on the platen 11 in the transport direction.

The head unit 16 has a length greater than or equal to the length of the sheet 14 in a direction (an orthogonal direction) orthogonal to the transport direction of the sheet 14. The head unit 16 includes a plurality of heads 20.

Each head 20 includes a stack structure including a channel unit and a volume changer. The channel unit includes liquid channels formed therein and a plurality of nozzle holes 21*a* open on a lower surface (an ejection surface 31*a*). The volume changer is driven to change the volume of a liquid channel. In this case, a meniscus in a nozzle hole 21*a* vibrates and liquid is ejected from the nozzle hole 21*a*. The head 20 will be described in detail later.

Separate tanks 12 are provided for different kinds of inks. For example, each of four tanks 12 stores therein a corresponding one of black, yellow, cyan, and magenta inks. Inks of the tanks 12 are supplied to corresponding nozzle holes 21*a*.

The controller 13 includes a processor such as a central processing unit (CPU), memories such as a random access memory (RAM) and a read only memory (ROM), and a driver integrated circuits (ICs) such as an application specific integrated circuit (ASIC). In the controller 13, upon receipt of various requests and detection signals from sensors, the CPU causes the RAM to store various data and outputs various execution commands to the ASIC based on programs stored in the ROM. The ASIC controls the driver ICs based on the commands to execute required operation. The transport motor and the volume changer are thereby driven.

Specifically, the controller 13 executes ejection from the head unit 16 and transport of sheets 14. The head unit 16 is controlled to eject ink from the nozzle holes 21*a*. A sheet 14 is transported in the transport direction. Printing progresses by execution of ink ejection and sheet transport.

<Structure of Head>

Figure 2:
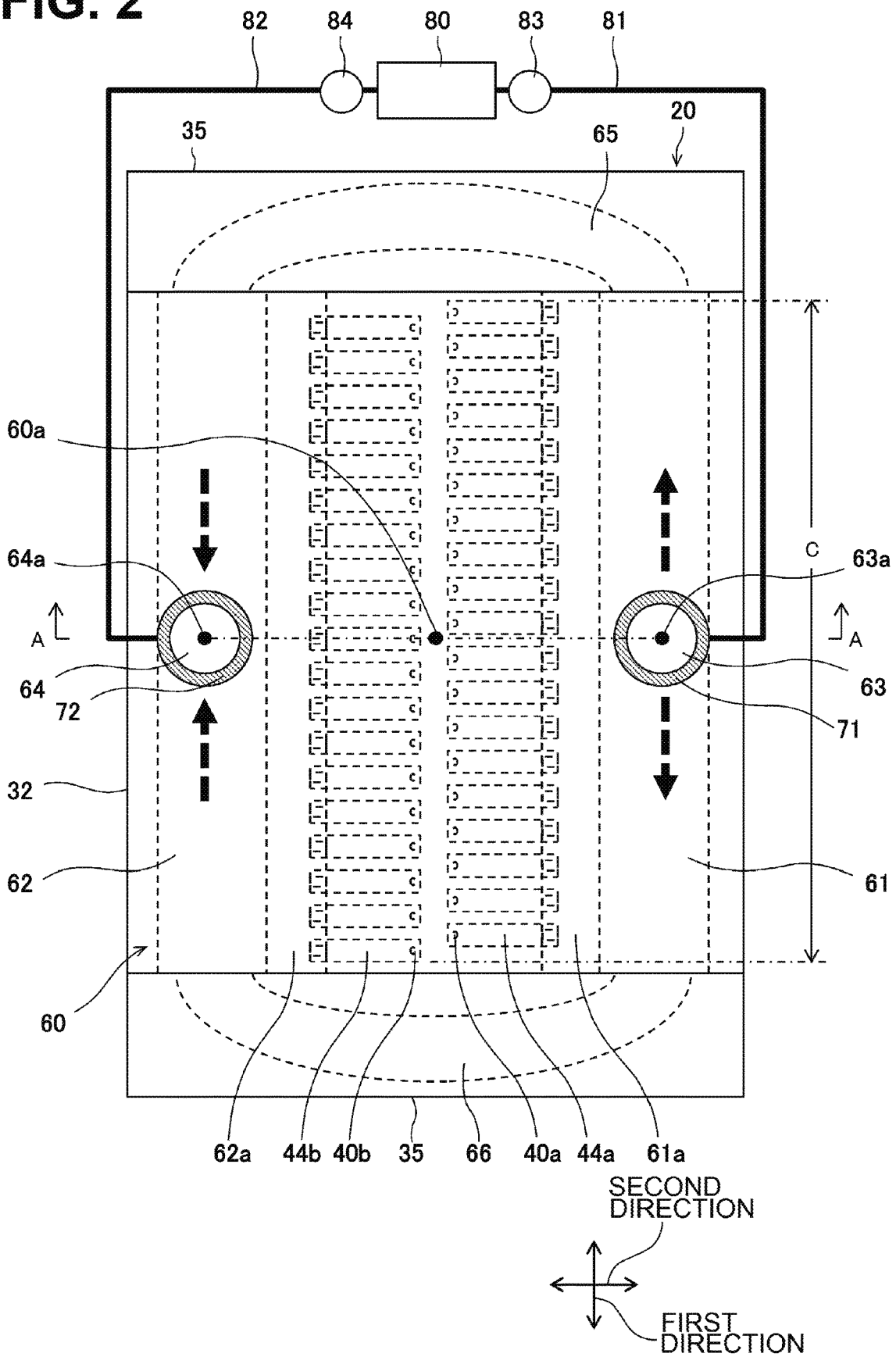
FIG. 2 is a schematic top view of the liquid ejection head of FIG. 1.
Figure 3:
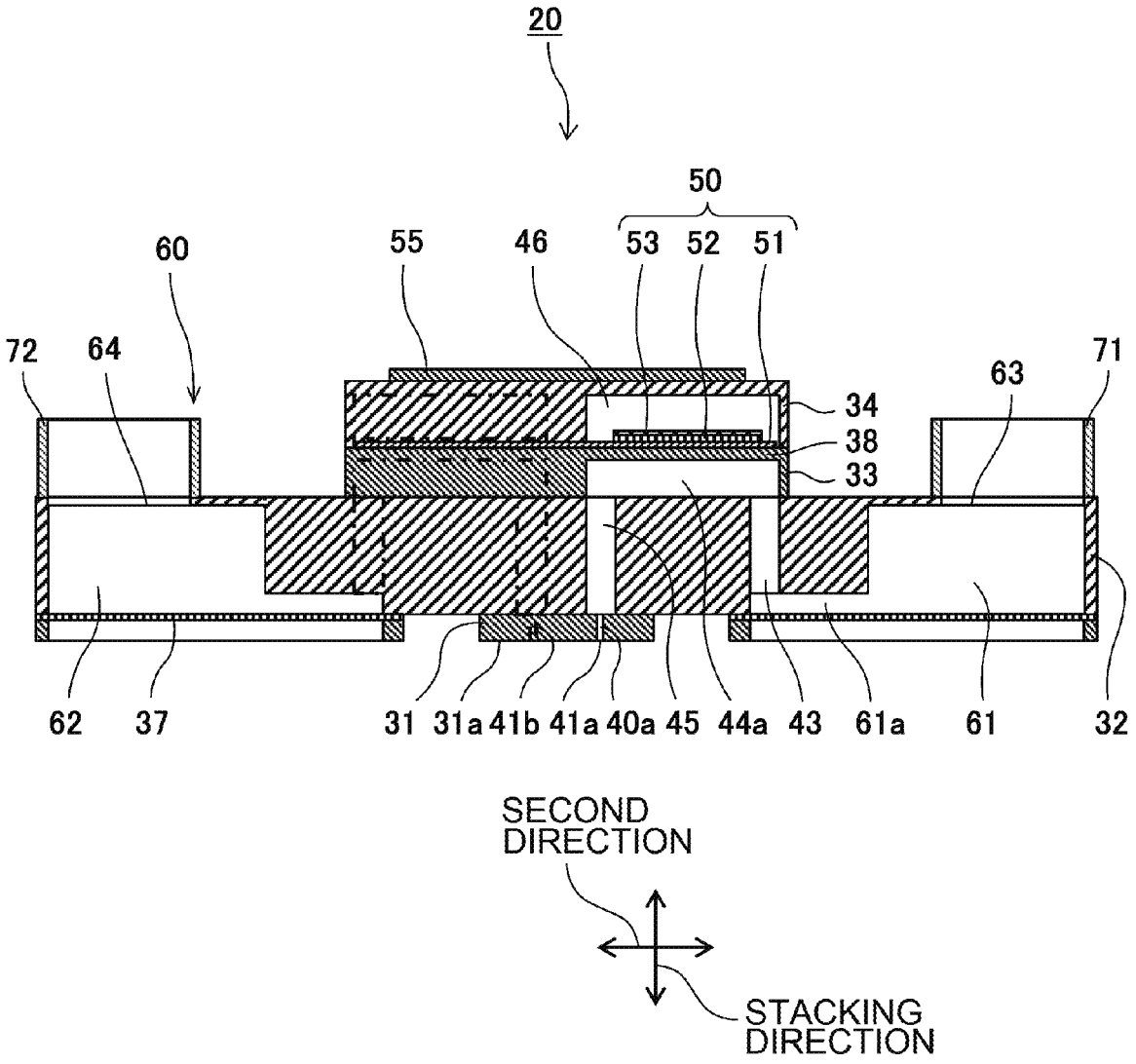
FIG. 3 is a cross-sectional view of the liquid ejection head taken along line A-A in FIG. 2.

As described above, each head 20 includes the channel unit and the volume changer. As shown in FIGS. 2 and 3, the channel unit is formed by a stack of a plurality of plates, and the volume changer includes piezoelectric elements 50 and a vibration plate 38.

The plurality of plates include a nozzle plate 31, a first channel plate 32, a second channel plate 33, and an accommodating plate 34. These plates are stacked in this order in a stacking direction.

Each plate has holes and grooves of various sizes. A combination of holes and grooves in the stacked plates of the channel unit define liquid channels such as a plurality of nozzles 40*a* and 40*b*, a plurality of individual channels, and a manifold 60. The manifold 60 includes a first channel 61 and a second channel 62. Each element will be described in detail later.

The nozzle plate 31 includes first nozzles 40*a* and second nozzles 40*b* formed therethrough in the stacking direction. The ejection surface 31*a* of the nozzle plate 31 has openings (first nozzle holes 41*a*) of the first nozzles 40*a* and openings (second nozzle holes 41*b*) of the second nozzles 40*b* respectively arranged in a first direction as a first nozzle array and a second nozzle array.

The first direction is orthogonal to the stacking direction and may be parallel or inclined relative to the orthogonal direction (a direction orthogonal to the transport direction of the sheet 14). A second direction is a direction orthogonal to the stacking direction and crossing (e.g., orthogonal to) the first direction, and may be parallel or inclined relative to the transport direction.

The first nozzle array and the second nozzle array are arranged parallel to each other, at an interval from each other in the second direction. The first nozzle holes 41*a* and the second nozzle holes 41*b* may be arranged in a staggered manner in the first direction or may be arranged side by side in the second direction.

The individual channels include first individual channels each connected to a corresponding first nozzle 40*a* and to the first channel 61, and second individual channels each connected to a corresponding second nozzle 40*b* and to the second channel 62. The first channel 61 and the second channel 62 sandwich the first individual channels and the second individual channels, which are respectively arranged to be next to the first nozzles 40*a* and the second nozzles 40*b*.

Each first individual channel includes a throttle channel 43, a first pressure chamber 44*a*, and a descender 45 which are arranged in this order. Each second individual channel includes a throttle channel 43, a second pressure chamber 44*b*, and a descender 45 which are arranged in this order. The first pressure chambers 44*a* and the second pressure chambers 44*b* are spaced from each other in the second direction and arranged in the first direction in an arrangement region C.

The first channel plate 32 includes the first channel 61, the second channel 62, the throttle channels 43 and the descenders 45. Each descender 45 penetrates the first channel plate 32 in the stacking direction and is connected, at its upper end, to a corresponding pressure chamber 44*a* or 44*b* and, at its lower end, to a corresponding nozzle 40*a* or 40*b*.

The first channel 61 and the second channel 62 are recessed from a lower surface of the first channel plate 32 and extend in the first direction. The first channel 61 has an L-shape in cross-section orthogonal to its extending direction and includes, at a lower portion of the L shape, a protrusion 61*a* protruding toward the first nozzles 40*a*. The second channel 62 has an L-shape in cross-section orthogonal to its extending direction and includes, at a lower portion of the L shape, a protrusion 62*a* protruding toward the second nozzles 40*b*.

Lower openings of the first channel 61 and the second channel 62 are covered by a damper film 37. The damper film 37 is a flexible film and deforms to reduce a pressure change in liquid in the first channel 61 and the second channel 62.

Each throttle channel 43 extends upward from a corresponding protrusion 61*a* or 62*a* to penetrate the first channel plate 32 in the stacking direction and is connected, at its upper end, to a corresponding pressure chamber 44*a* or 44*b*.

The second channel plate 33 includes the pressure chambers 44*a* and 44*b*. Each pressure chamber 44*a* or 44*b* is recessed from a lower surface of the second channel plate 33, extends in the second direction, and is connected, at its one end, to a corresponding throttle channel 43 and, at its other end, to a corresponding descender 45.

The second channel plate 33 includes a vibration plate 38 over the pressure chambers 44*a* and 44*b*. The vibration plate 38 may be separate from the second channel plate 33. In this case, the pressure chambers 44*a* and 44*b* may penetrate the second channel plate 33 in the stacking direction, and the vibration plate 38 may be stacked on the second channel plate 33 to cover upper openings of the pressure chambers 44*a* and 44*b*.

The accommodating plate 34 defines a first accommodating space 46 for accommodating therein piezoelectric elements 50. The first accommodating space 46 is located over the pressure chambers 44*a* and 44*b* to be recessed from a lower surface of the accommodating plate 34 and extends in the first direction. An electronic circuit with a driver IC 55 is located on the accommodating plate 34.

Each piezoelectric element 50 includes a common electrode 51, a piezoelectric layer 52, and an individual electrode 53 which are arranged in this order on the vibration plate 38. Each individual electrode 53 is provided over a corresponding pressure chamber 44*a* or 44*b*. The common electrode 51 entirely covers the vibration plate 38. In this case, a piezoelectric element 50 is formed by an active portion of a piezoelectric layer 52, which is sandwiched by an individual electrode 53 and the common electrode 51.

Each individual electrode 53 is electrically connected to the driver IC 55. The driver IC 55 receives control signals from the controller 13 (FIG. 1) and generates drive signals (voltage signals) selectively to the individual electrodes 53. In contrast, the common electrode 51 is constantly maintained at a ground potential.

In response to a drive signal, an active portion of each selected piezoelectric layer 52 expands and contracts in a surface direction, together with the two electrodes 51 and 53. Accordingly, the vibration plate 38 corporates to deform to increase and decrease the volume of a corresponding pressure chamber 44*a* or 44*b*. This applies a pressure to the corresponding pressure chamber 44*a* or 44*b* which in turn ejects liquid from a nozzle 40*a* or 40*b*.

<Structure of Manifold>

The manifold 60 is a common channel through which liquid is supplied to the individual channels and is connected to the individual channels. The manifold 60 includes the first channel 61, the second channel 62, a first opening 63, a second opening 64, a first communication passage 65, and a second communication passage 66.

The first channel 61 is connected to the first individual channels, while the second channel 62 is connected to the second individual channels. The first channel 61 and the second channel 62 extend longer than the arrangement region C in the first direction to sandwich therebetween in the second direction the first individual channels and the second individual channels. The first channel 61 and the second channel 62 have the same dimension in the first direction and the same cross-sectional area orthogonal to the first direction.

The first opening 63 is located at a center of the first channel 61 in the first direction. The first opening 63 is connected to an inner space of a first port 71 via a first hole located at an upper portion of the first channel plate 32.

The first port 71 is, for example, cylindrical and is attached to an upper surface of the first channel plate 32 to surround the first hole and protrude upward from the upper surface. Thus, the first channel 61 communicates with the inner space of the first port 71 via the first opening 63. The first port 71 may be integral with the first channel plate 32.

The second opening 64 is located at a center of the second channel 62 in the first direction. The second opening 64 is connected to an inner space of a second port 72 via a second hole located at an upper portion of the first channel plate 32.

The second port 72 is, for example, cylindrical and is attached to an upper surface of the first channel plate 32 to surround the second hole and protrude upward from the upper surface. Thus, the second channel 62 communicates with the inner space of the second port 72 via the second opening 64. The second port 72 may be integral with the second channel plate 32.

The first opening 63 and the second opening 64 are located on a straight line extending in the second direction and have the same size and shape. The first opening 63 is located on an opposite side of the first channel 61 from the first pressure chambers 44*a* in the second direction. The second opening 64 is located on an opposite side of the second channel 62 from the second pressure chambers 44*b* in the second direction.

The first communication passage 65 is connected to one end of the first channel 61 and to one end of the second channel 62. The second communication passage 66 is connected to the other end of the first channel 61 and to the other end of the second channel 62. Thus, the first channel 61 and the second channel 62 communicate with each other via the first communication passage 65 and the second communication passage 66.

The first communication passage 65 and the second communication passage 66 are defined by a forming member 35 which is made of, for example, resin and fixed to the first channel plate 32. The forming member 35 may be integral with the first channel plate 32.

The cross-sectional area defined by the first communication passage 65 to be orthogonal to its axis is less than that of each of the first channel 61 and the second channel 62. The cross-sectional area defined by the second communication passage 66 to be orthogonal to its axis is less than that of each of the first channel 61 and the second channel 62. The cross-sectional area of the first communication passage 65 is equal to that of the second communication passage 66.

The first communication passage 65 is curved such that the inclination of its portion farther from the first channel 61 changes from the first direction further toward the second direction. Likewise, The second communication passage 66 is curved such that the inclination of its portion farther from the second channel 62 changes from the first direction further toward the second direction. Thus, the first communication passage 65 and the second communication passage 66 are curved to protrude away from each other and are symmetrical with respect to a line while sandwiching the first channel 61 and the second channel 62.

Thus, the manifold 60, which includes the first channel 61, the second channel 62, the first communication passage 65, and the second communication passage 66, surrounds the first pressure chambers 44*a* and the second pressure chambers 44*b* in a direction orthogonal to the stacking direction, that is, in a direction including the first direction and the second direction. When viewed in the stacking direction, the first opening 63 and the second opening 64 are symmetrical with respect to a center point 60*a* of the manifold 60.

<Liquid Flow in Manifold>

As shown in FIG. 2, the first port 71 is connected to a subtank 80 via a supply conduit at which a pressure pump 83 is located. The second port 72 is connected to the subtank 80 via a return conduit at which a negative pressure pump 84 is located. The subtank 80, which may be disposed above the head 20, is connected to a tank 12 (FIG. 1).

When the pumps 83 and 84 are driven, liquid from the subtank 80 passes through the supply conduit 81 to flow, via the inner space of the first port 71 and the first opening, into a center of the first channel 61. In this case, liquid flows, from above, into the first channel 61 and flows down the first channel 61 to collide with its bottom. This disperses components, such as pigments, contained in the liquid, thereby reducing settling of the components.

The liquid flow branches at the center in the first direction toward opposite ends of the first channel 61 along the first direction. Part of the liquid flows into the first individual channels, passes the throttle channels 43, the first pressure chambers 44*a*, and the descenders 45 in this order, reaches the first nozzles 40*a*, and is ejected from the first nozzles 41*a*.

The remaining liquid flows from one end of the first channel 61 into the first communication passage 65 and from the other end of the first channel 61 into the second communication passage 66. The liquid flows along the curved communication passages 65 and 66. The direction of liquid flow gradually changes toward one side in the first direction, toward the second direction, and toward the other side in the first direction. Thus, liquid flows smoothly in the communication passages 65 and 66 to discharge air bubbles.

The liquid flows from the communication passages 65 and 66 into the second channel 62, through opposite ends toward a center of the second channel 62 in the first direction. Part of the liquid flows into the second individual channels, passes the throttle channels 43, the second pressure chambers 44*b*, and the descenders 45 in this order, reaches the second nozzles 40*b*, and is ejected from the second nozzle holes 41*b*.

As the remaining liquid, the liquid from the first communication passage 65 and the liquid from the second communication passage 66 meet at the center in the second channel 62. This disperses the components contained in the liquid, thereby reducing settling of the components.

Then, the liquid is discharged from the center of the second channel 62, via the second opening 64 and the inner space of the second port 72, and returns, via the return conduit, to the subtank 80. Thus, the liquid not having flown into the individual channels circulates between the subtank 80 and the manifold 60.

<Printing>

Figure 4:
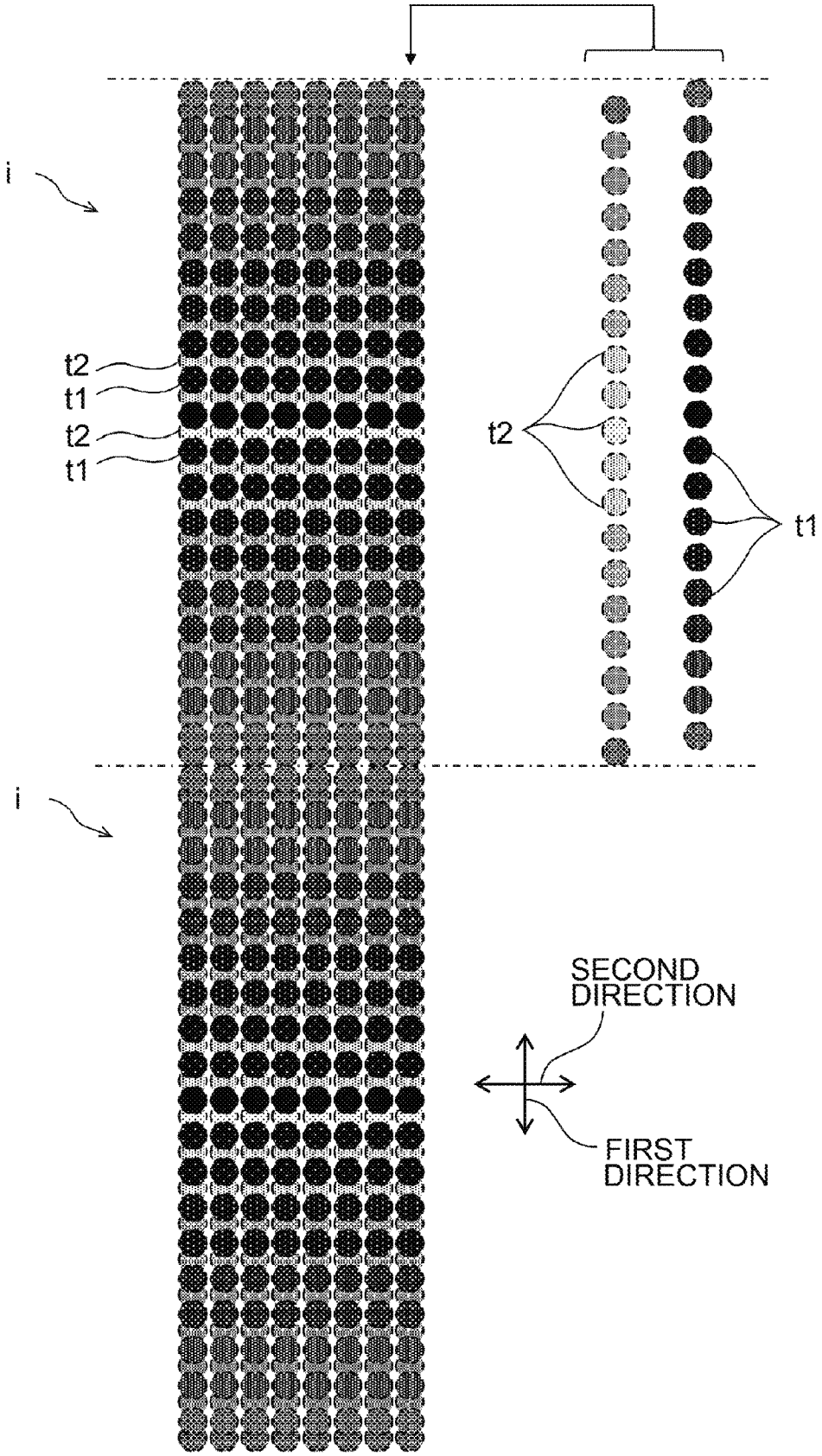
FIG. 4 is a diagram showing dots ejected by the liquid ejection apparatus of FIG. 1.

Printing is performed by liquid ejection and sheet transport. As shown in FIG. 4, by ejection of liquid from the nozzles 40*a* and 40*b*, liquid dots (first dots t1) ejected from the first nozzle holes 41*a* are formed in the first direction, and liquid dots (second dots t2) ejected from the second nozzle holes 41*b* are formed in the first direction.

<Effects>

In the head 20, the manifold 60 includes the first channel 61, the first opening 63, the second channel 62, the second opening 64, the first communication passage 65, and the second communication passage 66. The first channel 61 communicates with the first pressure chambers 44*a* and includes the first opening 63 through which liquid enter from an exterior. The second channel 62 communicates with the second pressure chambers 44*b* and includes the second opening 64 through which liquid exits to the exterior. The first communication passage 65 communicates one end of the first channel 61 with one end of the second channel 62. The second communication passage 66 communicates the other end of the first channel 61 with the other end of the second channel 62.

As liquid flows in the manifold 60, components contained in the liquid settle down, causing a decrease in concentration of the liquid. Nevertheless, the first opening 63 is located at the first channel 61 and the second opening 64 is located at the second channel 62. Thus, a distance between any portion of the first channel 61 and the first opening 63 and a distance between any portion of the second channel 62 and the second opening 64 are relatively small, thereby reducing differences in liquid concentration.

This may reduce differences in liquid concentration in the first direction of partial images i formed by liquid ejected through the nozzles 41*a* and 41*b* from the channels 61 and 62, respectively. Consequently, the degradation of image quality due to differences in liquid concentration may be reduced.

Because liquid flows from the first channel 61 to the second channel 62, the liquid in the first channel 61 is higher in concentration than the liquid in the second channel 62. Herein, the first channel 61 and the second channel 62 are arranged in the second direction.

First dots t1 formed by the liquid ejected from the nozzle holes 41*a* communicating with the first channel 61 are thicker than second dots t2 formed by the liquid ejected from the nozzle holes 41*b* communicating with the second channel 62. Among the first dots t1 arranged in the first direction, a first dot t1 closer to a center in the first direction is thicker. Among the second dots t2 arranged in the first direction, a second dot t2 closer to a center in the first direction is thinner.

A thicker first dot t1 compensates for a thinner second dot t2. Consequently, the degradation of image quality due to differences in liquid concentration may be reduced.

Unlike the above-described embodiment, providing the openings 63 and 64 at the communication passages 65 and 66, respectively, increases the sizes of the communication passages 65 and 66 depending on the sizes of the openings 63 and 64, respectively. However, in the head 20, the openings 63 and 64 are not provided at the communication passages 65 and 66, respectively. Thus, the communication passages 65 and 66 are reduced in size, regardless of the size and position of the openings 63 and 64. The manifold 60, which is single and common to the first nozzle array and the second nozzle array, makes the head 20 compact.

In the head 20, the first communication passage 65 and the second communication passage 66 are curved to protrude away from each other. This structure allows liquid to flow along the curved communication passages 65 and 66 without stagnation, thereby discharging air bubbles.

In the head 20, the cross-sectional area defined by the first communication passage 65 to be orthogonal to its extending direction is less than that defined by the first channel 61 to be orthogonal to its extending direction. Likewise, the cross-sectional area defined by the second communication passage 66 to be orthogonal to its extending direction is less than that defined by the second channel 62 to be orthogonal to its extending direction. This structure makes the flow velocity of liquid in the communication passages 65 and 66 higher than that in the channels 61 and 62, respectively, thereby discharging air bubbles from the communication passages 65 and 66, via the channel 62 and the second opening 64, to the exterior.

In the head 20, the cross-sectional area of the first communication passage 65 is equal to that of the second communication passage 66, and the cross-sectional area of the first channel 61 is equal to that of the second channel 62. This structure makes the flow path resistance of the first communication passage 65 equal to that of the second communication passage 66, and the flow path resistance of the first communication passage 61 equal to that of the second channel 62. This makes similar changes in liquid concentration in the first channel 61 in response to the distance from the first opening 63 to those in the second channel 62 in response to the distance from the second opening 64.

In the head 20, the first opening 63 is located at a center of the first channel 61 in an extending direction of the first channel 61. Likewise, the second opening 64 is located at a center of the second channel 62 in an extending direction of the second channel 62. This structure may prevent an increase in length in the first direction of the first channel 61 from the first opening 63 and an increase in length in the first direction of the second channel 62 from the second opening 64, thereby reducing differences in liquid concentration in the channels 61 and 62 in the first direction.

In the head 20, a center 63*a* of the first opening 63 is located opposite to the first pressure chambers 44*a* relative to a center of the first channel 61 in a direction orthogonal to the extending direction of the first channel 61. A center 64*a* of the second opening 64 is located opposite to the second pressure chambers 44*b* relative to a center of the second channel 62 in a direction orthogonal to the extending direction of the second channel 62.

Unlike this embodiment, providing the openings 63 and 64 at sides of the channels 61 and 62 closer to the pressure chambers 44*a* and 44*b*, respectively, causes stagnation of the liquid at sides farther from the pressure chambers 44*a* and 44*b*. In contrast, providing the openings 63 and 64 at sides of the channels 61 and 62 farther from the pressure chambers 44*a* and 44*b*, respectively, reduces stagnation of the liquid there. In response to liquid ejection from the nozzles 40*a* and 40*b*, liquid flows into the pressure chambers 44*a* and 44*b*, respectively. Thus, the liquid flows at sides closer to the pressure chambers 44*a* and 44*b*, thereby reducing stagnation of the liquid there.

First Modification

Figure 5:
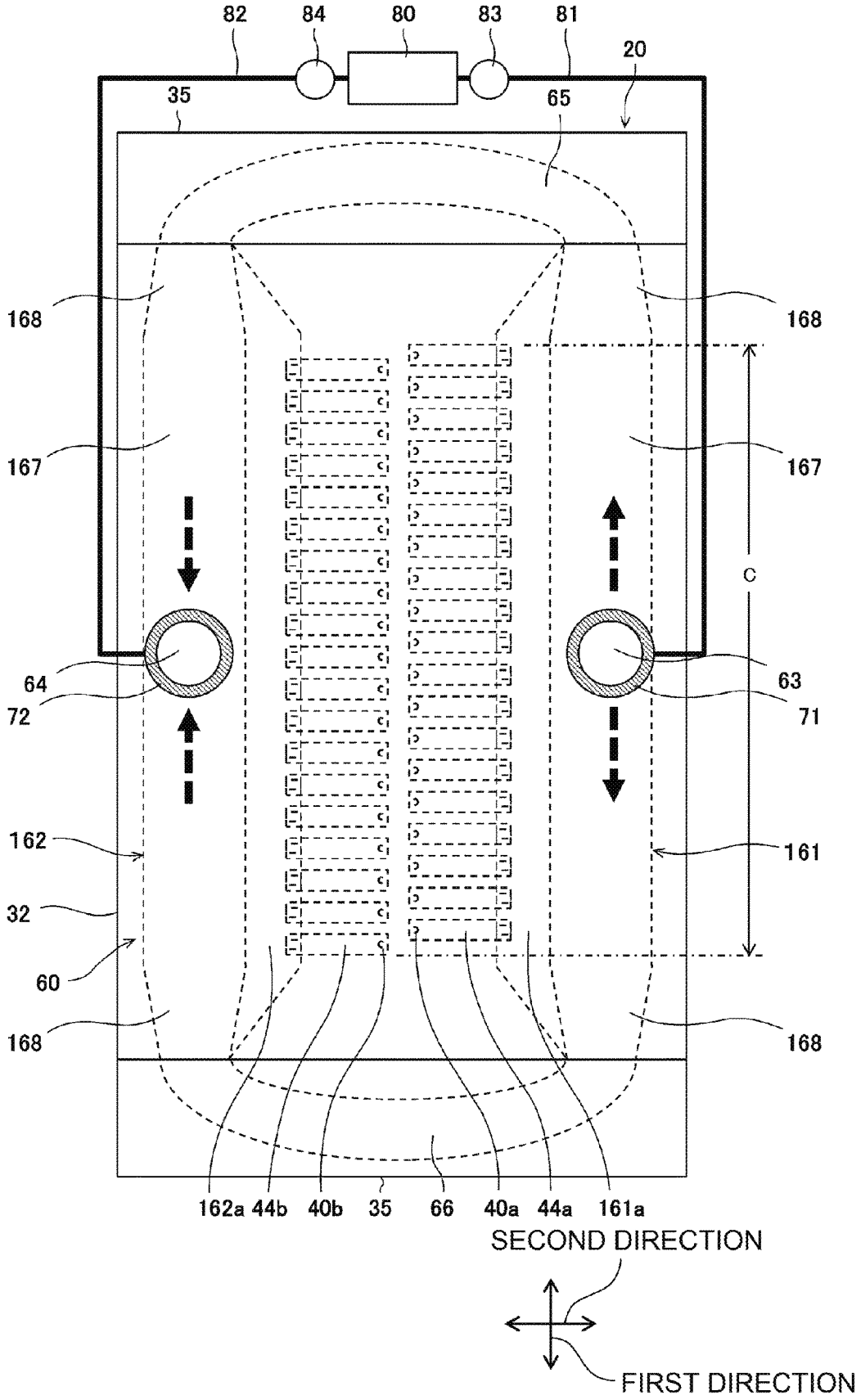
FIG. 5 is a schematic top view of a liquid ejection head according to a first modification of the first illustrative embodiment.

In a head 20 according to a first modification of the first illustrative embodiment, as shown in FIG. 5, each connection portion of a first channel 161 connected to a corresponding communication passage 65 or 66 may have a cross-sectional shape asymptotically similar to that of the corresponding communication passage 65 or 66. Each connection portion of a second channel 162 connected to a corresponding communication passage 65 or 66 may have a cross-sectional shape asymptotically similar to that of the communication passage 65 or 66. The elements other than the above-described elements are similar, in structure, function, and effect, to those of the first illustrative embodiment and will not be described repeatedly.

For example, each of the channels 161 and 162 includes a pair of tapered portions 168 sandwiching a straight portion 167 therebetween in the first direction. Each straight portion 167 is located in a corresponding arrangement region C and has a uniform cross-section in the first direction.

One and the other tapered portions 168 are located at one and the other ends of a corresponding arrangement region C. Each tapered portion 168 is tapered from one end or the other end of the corresponding arrangement region C and has a small diameter end and a large diameter end which is larger in dimension than the small diameter end. Each large diameter end is connected to an end of a corresponding straight portion 167 and has the same size and shape as the corresponding straight portion 167. Each small diameter end is connected to an end of a corresponding communication passage 65 or 66 and has the same size and shape as the corresponding communication passage 65 or 66.

Each tapered portion 168 is continuously tapered from a corresponding straight portion 167 toward a corresponding communication passage 65 or 66 without a step or a corner between the tapered portion 168 and the corresponding straight portion 167 and between the tapered portion 168 and the corresponding communication passage 65 or 66. This allows a smooth liquid flow along the tapered portion 168 between the corresponding straight portion 167 and communication passage 65 or 66, thereby efficiently dispersing the liquid components and discharging air bubbles.

Second Modification

Figure 6:
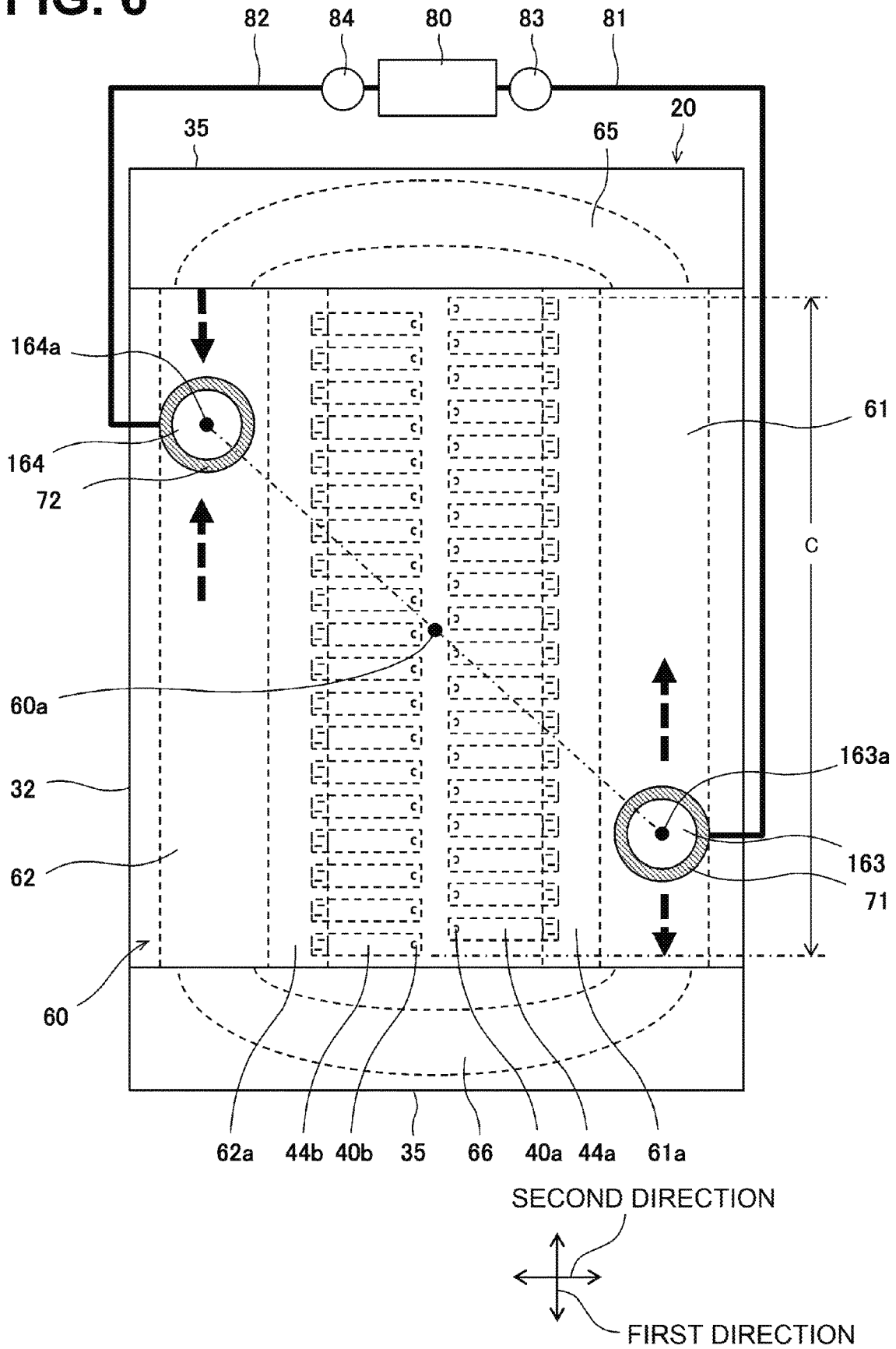
FIG. 6 is a schematic top view of a liquid ejection head according to a second modification of the first illustrative embodiment.

In a head 20 according to a second modification of the first illustrative embodiment, as shown in FIG. 6, a first opening 163 and a second opening 164 may be located symmetrically with respect to the center point 60*a* of the manifold 60 which surrounds the first pressure chambers 44*a* and the second pressure chambers 44*b*. The elements other than the above-described elements are similar, in structure, function, and effect, to those of the first illustrative embodiment and will not be described repeatedly.

In contrast, as shown in FIG. 2, the first opening 63 and the second opening 64 are located to interpose the center point 60*a* therebetween in the second direction. The first opening 163 and the second opening 164 are not so limited as long as the first and second openings 163 and 164 are symmetrical with respect to the center point 60*a*. For example, as shown in FIG. 6, the first opening 163 is closer to the second communication passage 66 in the first direction than the second opening 164. In this case, a center 163*a* of the first opening 163, the center point 60*a*, and a center 164*a* of the second opening 164 are arranged in this order on the same straight line.

This structure may prevent an increase in length in the first direction from the first opening 163 to opposite ends of the first channel 61 and from the second opening 164 to opposite ends of the second channel 62, thereby reducing differences in liquid concentration in the first direction. In addition, the first opening 163 and the second opening 164 are offset from each other in the first direction and are not aligned in the second direction. This facilitate piping between the first port 71 on the first opening 163 and the second port 72 on the second opening 164.

Third Modification

Figure 7:
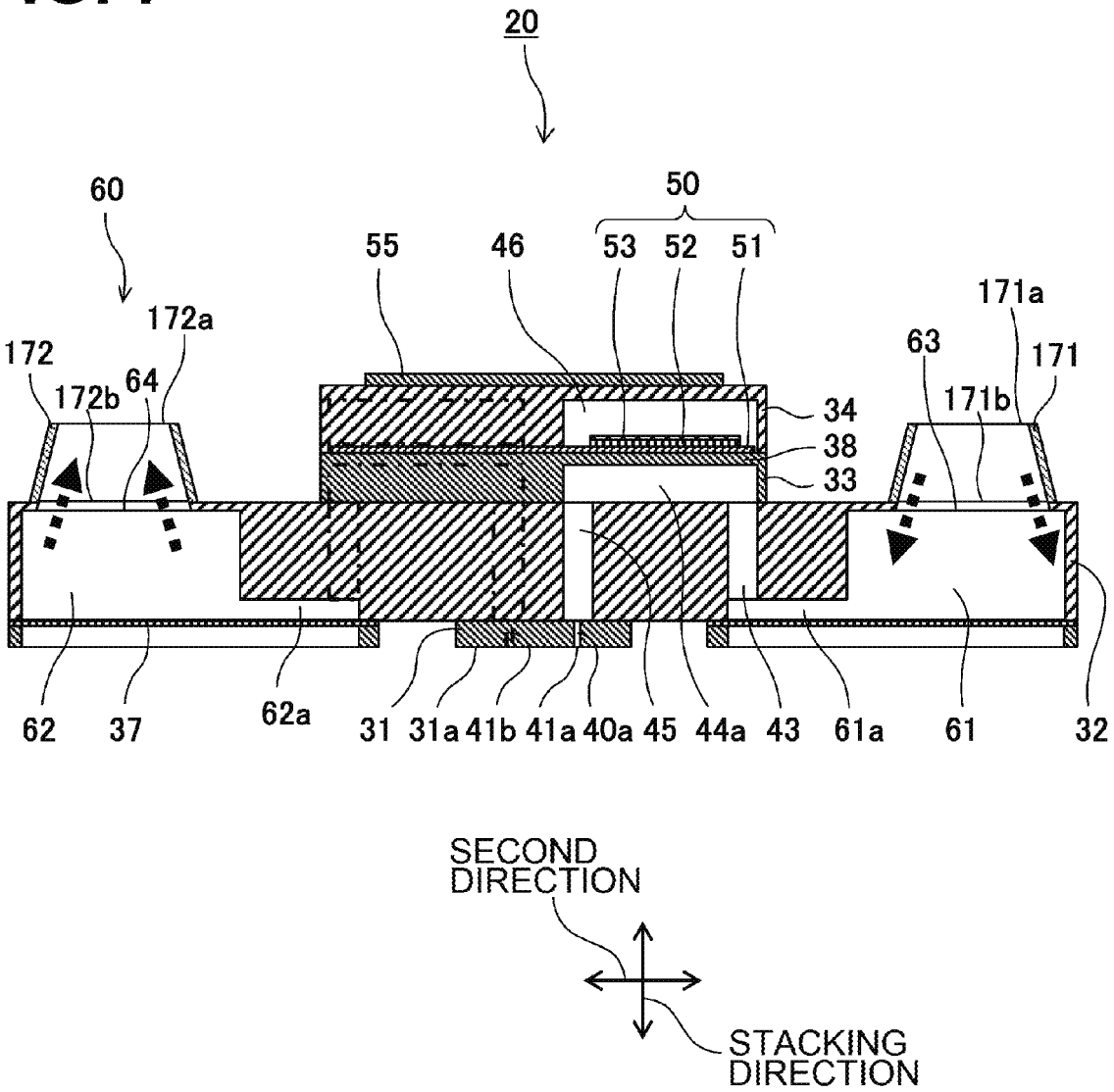
FIG. 7 is a cross-sectional view of a liquid ejection head according to a third modification of the first illustrative embodiment.

In a head 20 according to a third modification of the first illustrative embodiment, as shown in FIG. 7, a first port 171 whose inner space communicates with the first opening 63 may increase in diameter toward the first channel 61. A second port 172 whose inner space communicates with the second opening 64 may decrease in diameter in a direction away from the second channel 62. The elements other than the above-described elements are similar, in structure, function, and effect, to those of the first illustrative embodiment and will not be described repeatedly.

The first port 171 has a first upper end opening 171*a* and a first lower end opening 171*b* which is smaller in dimension than the first upper end opening 171*a*. The first port 171 has a shape of a corn without its tip, such as a circular truncated cone, and has a straight inclined surface such that a cross-sectional area of the first port 171 increases from the first upper end opening 171*a* toward the first lower end opening 171*b*.

The first lower end opening 171*b* is connected, via the first hole, to the first opening 63 of the first channel 61, and the inner space of the first port 171 communicates, via the first opening 63, with the first channel 61. Liquid flows from the first port 171 into the first channel 61 in a vertical direction and in a direction orthogonal to the vertical direction. This evenly disperses the liquid in a wide range of the first channel 61.

The second port 172 has a second upper end opening 172*a* and a second lower end opening 172*b* which is smaller in dimension than the first upper end opening 172*a*. The second port 172 has a shape of a corn without its tip, such as a circular truncated cone, and has a straight inclined surface such that a cross-sectional area of the second port 172 decreases from the second lower end opening 172*b* toward the second upper end opening 172*a*.

The second lower end opening 172*b* is connected, via the second hole, to the second opening 64 of the second channel 62, and the inner space of the second port 172 communicates, via the second opening 64, with the second channel 62. When liquid flows from the second channel 62 into the second port 172, the flow velocity increases as the second port 172 decreases in diameter. This efficiently discharges air bubbles from the second channel 62.

Second Illustrative Embodiment

Figure 8:
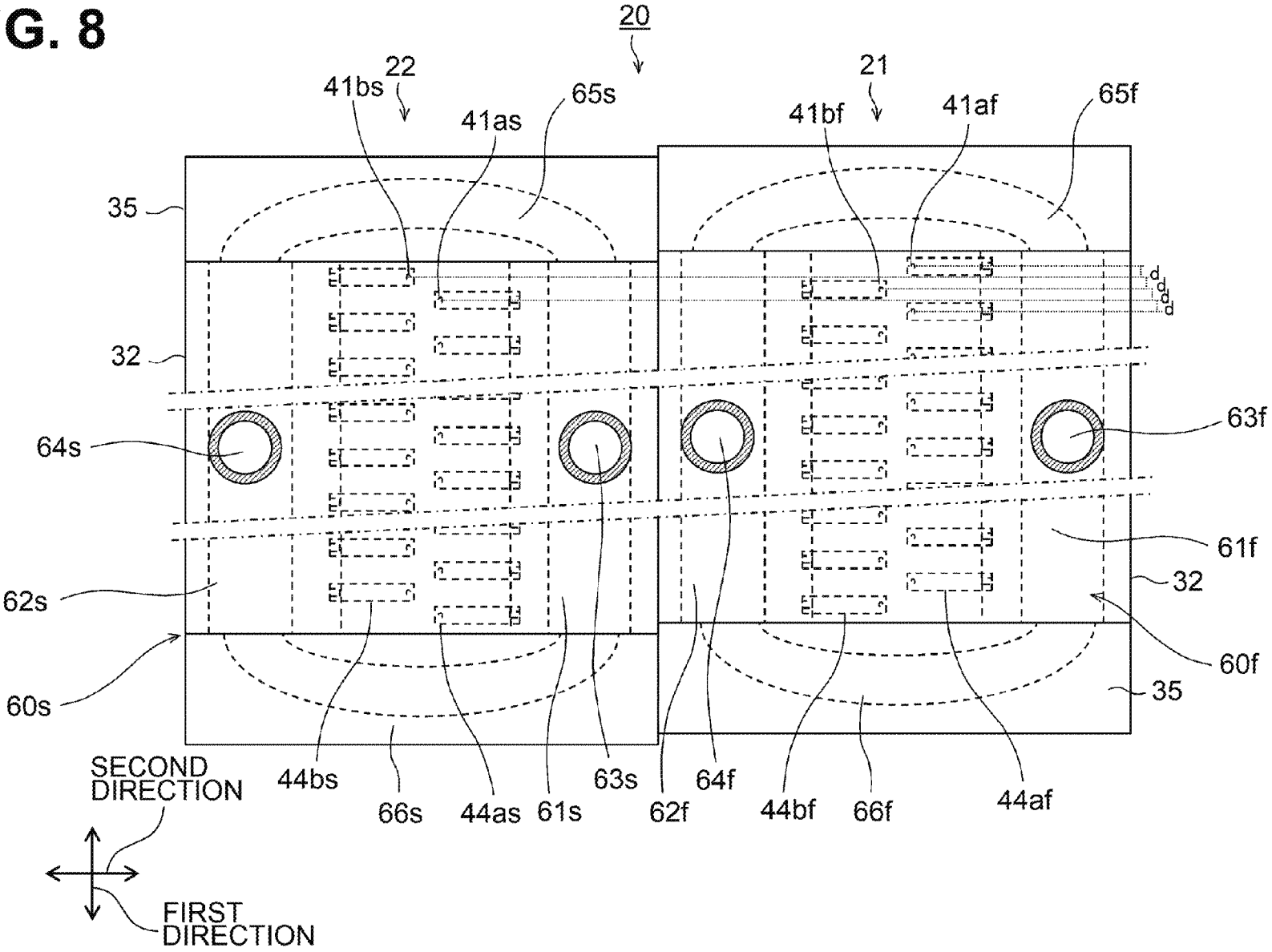
FIG. 8 is a schematic top view of a liquid ejection head according to a second illustrative embodiment.

In a head 20 according to a second illustrative embodiment, as shown in FIG. 8, a first unit 21 and a second unit 22 may be arranged in a second direction. The elements other than the above-described elements are similar, in structure, function, and effect, to those of the first illustrative embodiment and will not be described repeatedly.

Specifically, the first unit 21 includes first nozzle holes 41*af*, second nozzle holes 41*bf*, first pressure chambers 44*af*, second pressure chambers 44*bf*, and a manifold 60*f*. The manifold 60*f* includes a first channel 61*f*, a first opening 63*f*, a second channel 62*f*, a second opening 64*f*, a first communication passage 65*f*, and a second communication passage 66*f*.

The second unit 22 includes first nozzle holes 41*as*, second nozzle holes 41*bs*, first pressure chambers 44*as*, second pressure chambers 44*bs*, and a manifold 60*s*. The manifold 60*s* includes a first channel 61*s*, a first opening 63*s*, a second channel 62*s*, a second opening 64*s*, a first communication passage 65*s*, and a second communication passage 66*s*.

The first unit 21 and the second unit 22 are arranged next to each other in the second direction. The first unit 21 and the second unit 22 are arranged such that in the second direction, the second channel 62*f* and the first channel 61*s*, which are next to each other, are located between the first channel 61*f* and the second channel 62*s*.

The first opening 63*f* and the first opening 63*s* are connected to a supply opening of a subtank 80 for the same liquid. The second opening 64*f* and the second opening 64*s* are connected to a discharge opening of the subtank 80 for the same liquid. The openings 63*f*, 63*s*, 64*f*, and 64*s* may be connected to the common subtank 80 or to separate subtanks 80 for the same kind of liquid. The same kind of liquid is supplied to the first openings 63*f* and 63*s*, passes through the manifolds 60*f* and 60*s*, and is discharged from the second openings 64*f* and 64*s*, respectively.

A first nozzle hole array of the first nozzle holes 41*af*, a second nozzle hole array of the second nozzle 1 holes 41*bf*, a first nozzle hole array of the first nozzle holes 41*as*, and a second nozzle hole array of the second nozzle holes 41*bs* are arranged in this order in the second direction and are parallel to each other.

In the first unit 21, the first nozzle holes 41*af* and the second nozzle holes 41*bf* are arranged alternately with each other in the first direction. In the second unit 22, the first nozzle holes 41*as* and the second nozzle holes 41*bs* are arranged alternately with each other in the first direction.

In each nozzle array, an nth (n is a natural number) first nozzle hole 41*af*, an nth second nozzle hole 41*bs*, an nth second nozzle hole 41*bf*, and an nth first nozzle hole 41*as* are arranged in this order, at equal intervals d, in the first direction. The order of the nozzle holes arranged in the first direction is not so limited as long as the first nozzle holes 41*af* and the second nozzle holes 41*bf* of the first unit 21, and the first nozzle holes 41*as* and the second nozzle holes 41*bs* of the second unit 22 are arranged at equal intervals in the first direction.

In other words, an interval between a first nozzle hole 41*af* and a second nozzle hole 41*bs* which are adjacent to each other in the first direction is equal to the interval d. An interval between a second nozzle hole 41*bs* and a second nozzle hole 41*bf* which are adjacent to each other in the first direction is equal to the interval d. An interval between a second nozzle hole 41*bf* and a first nozzle hole 41*as* which are adjacent to each other in the first direction is equal to the interval d.

Further, an nth first nozzle hole 41*as* and an (n+1)th first nozzle hole 41*af* are adjacent to each other, at the interval d, in the first direction. The first nozzle hole 41*af*, second nozzle hole 41*bs*, second nozzle hole 41*bf*, and first nozzle hole 41*as* are arranged at the predetermined intervals d in the first direction and are spaced from each other in the second direction.

Thus, dots formed by liquid ejected from these nozzle holes 41*a* and 41*b* are arranged in the first direction at equal intervals in the first direction to form an image. This may reduce unevenness in color of an image.

The use of the two units 21 and 22 makes smaller the interval d between two adjacent ones of the nozzle holes 41*af*, 41*bf*, 41*as*, and 41*bs*. This increases the density of dots in the image.

Further, in the first unit 21, the first nozzle holes 41*af* and the second nozzle holes 41*bf* are arranged alternately with each other at equal intervals in the first direction. In the second unit 21, the first nozzle holes 41*as* and the second nozzle holes 41*bs* are arranged alternately with each other at equal intervals in the first direction. This allows to selectively use one or a combination of the units 21 and 22, thereby reducing the cost of a product.

The structure of at least one of the first, second, and third modifications may be applied to the head 20 according to the second illustrative embodiment.

Third Illustrative Embodiment

Figure 9:
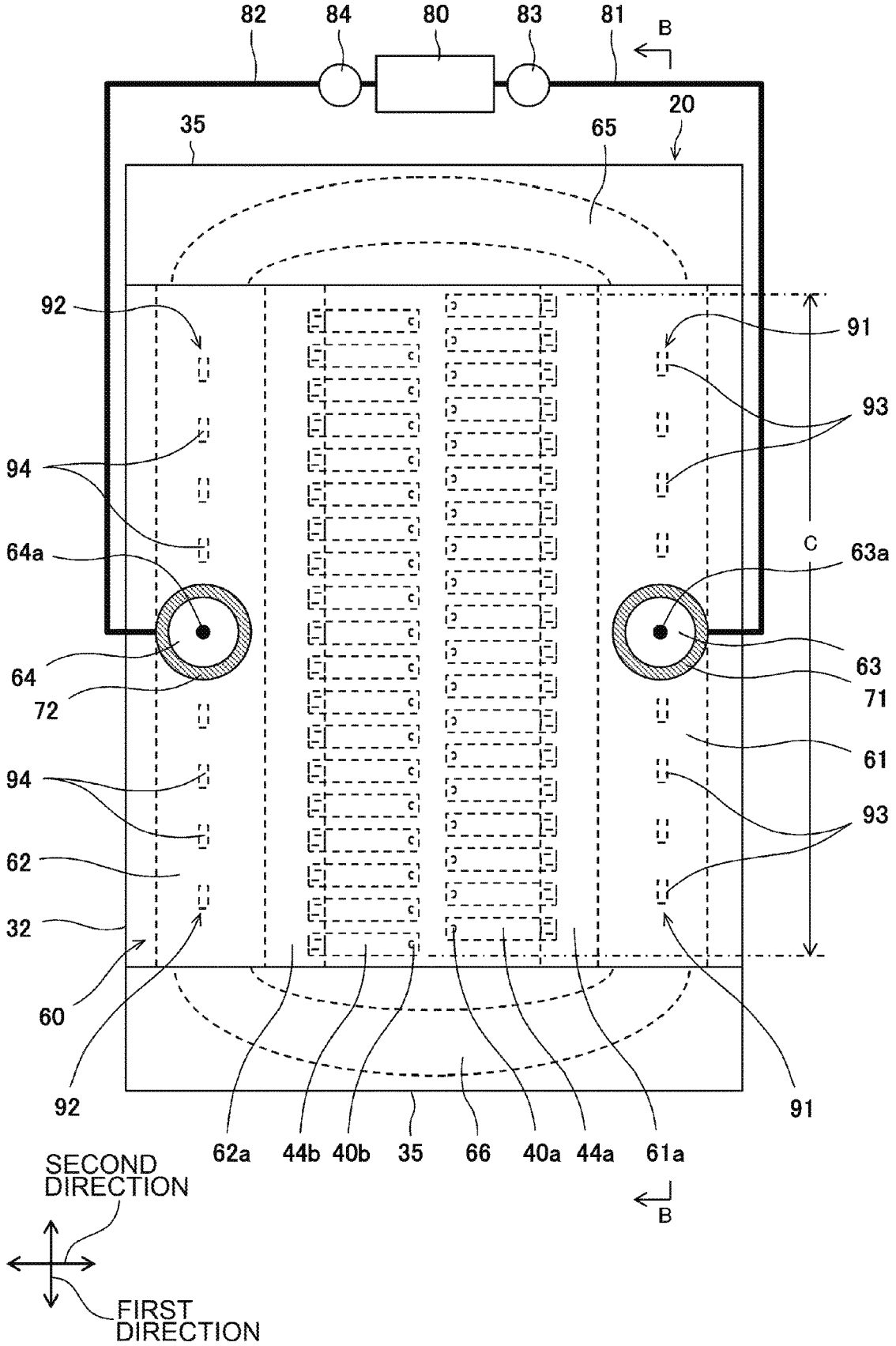
FIG. 9 is a schematic top view of a liquid ejection head according to a third illustrative embodiment.
Figure 10:
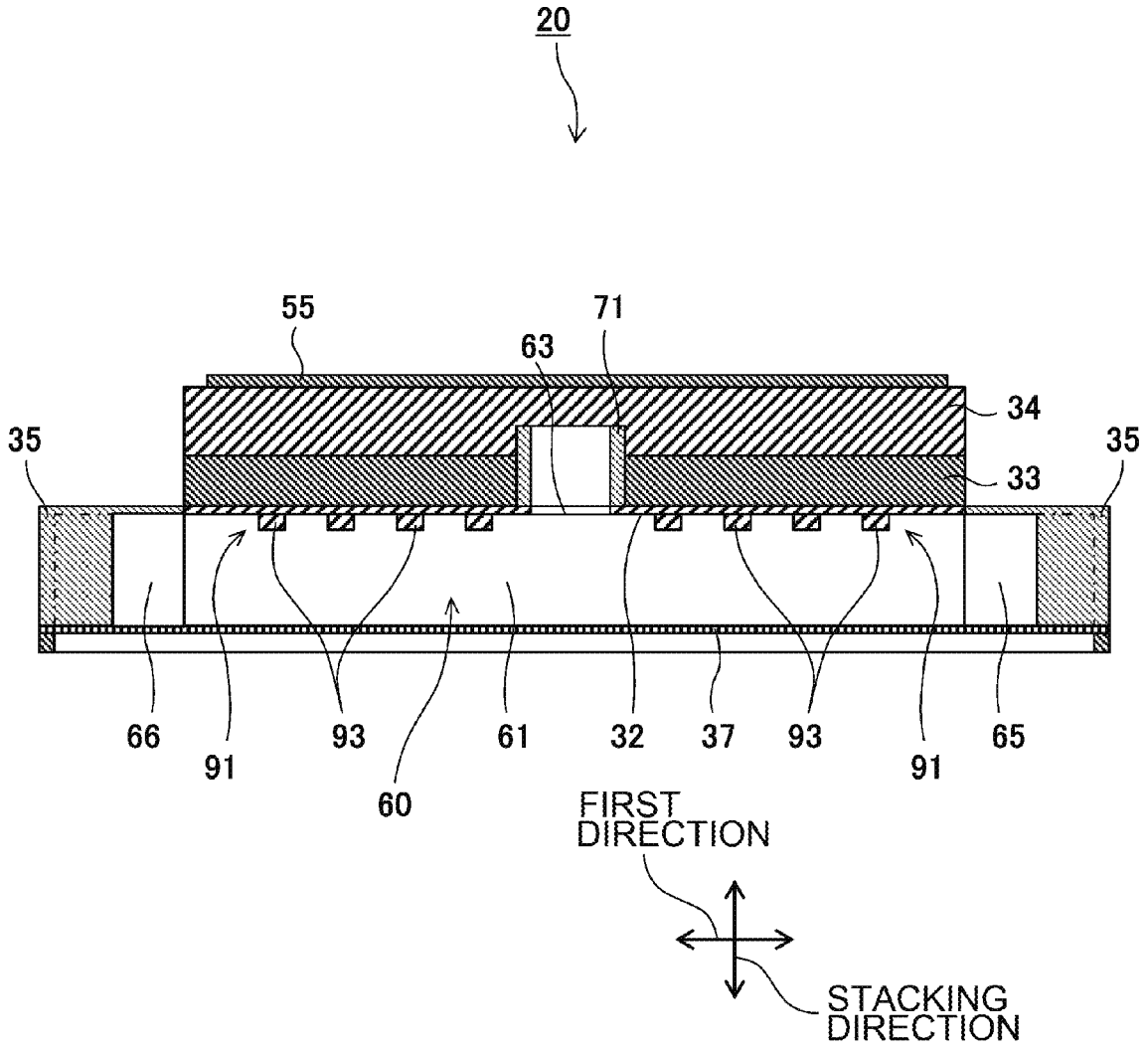
FIG. 10 is a cross-sectional view of the liquid ejection head taken along line B-B in FIG. 9.

In a head 20 according to a third illustrative embodiment, as shown in FIGS. 9 and 10, a manifold 60 may include, at its upper surface, protruding members protruding downward. The elements other than the above-described elements are similar, in structure, function, and effect, to those of the first illustrative embodiment and will not be described repeatedly.

Specifically, as the protruding members, first protruding members 91 and second protruding members 92 are located in a first channel 61 and a second channel 62, respectively. The first protruding members 91 and the second protruding members 92 may have the same dimensions and shape.

Each first protruding member 91 extends in a first direction between a first opening 63 and a first communication passage 65 or between the first opening 63 and a second communication passage 66. Each second protruding member 92 extends in the first direction between a second opening 64 and the first communication passage 65 or between the second opening 64 and the second communication passage 66.

The first protruding members 91 are aligned with a center 63*a* of the first opening 63 in the first direction, and the second protruding members 92 are aligned with a center 64*a* of the second opening 64. The first protruding members 91 are located at a center of the first channel 61 in a second direction, and the second protruding members 92 are located at a center of the second channel 62 in the second direction.

Each first protruding member 91 includes a plurality of first protrusions 93 arranged at intervals in the first direction. Each second protruding member 92 includes a plurality of second protrusions 94 arranged at intervals in the first direction. Each of the protrusions 93 and 94 extends longer in the first direction than in the second direction.

Each of the protruding members 91 and 92 protrudes downward from an upper surface of a corresponding channel 61 or 62. Liquid flows down along the protruding members 91 and 92 in the channels 61 and 62, respectively. This reduces settling down of the liquid components and differences in liquid concentration.

The protruding members 91 and 92 respectively extend in the channels 61 and 62 in their extending directions (the first direction). Liquid flows along the protruding members 91 and 92 in an extending direction of the manifold 60. The liquid flow moves air bubbles, thereby reducing stagnation of air bubbles.

Further, the protruding members 91 and 92 respectively include the protrusions 93 and 94 arranged at intervals. Air bubbles pass through and exit from the intervals between adjacent protrusions 93 and the intervals between adjacent protrusions 94.

In the above-described structure, the first channel 61 includes the first protruding members 91, and the second channel 62 includes the second protruding members 92. Alternatively, the first channel 61 may include the first protruding members 91, and the second channel 62 may include no second protruding member 92. Alternatively, the first channel 61 may include no first protruding member 91, and the second channel 61 may include the second protruding members.

Fourth Modification

Figure 11:
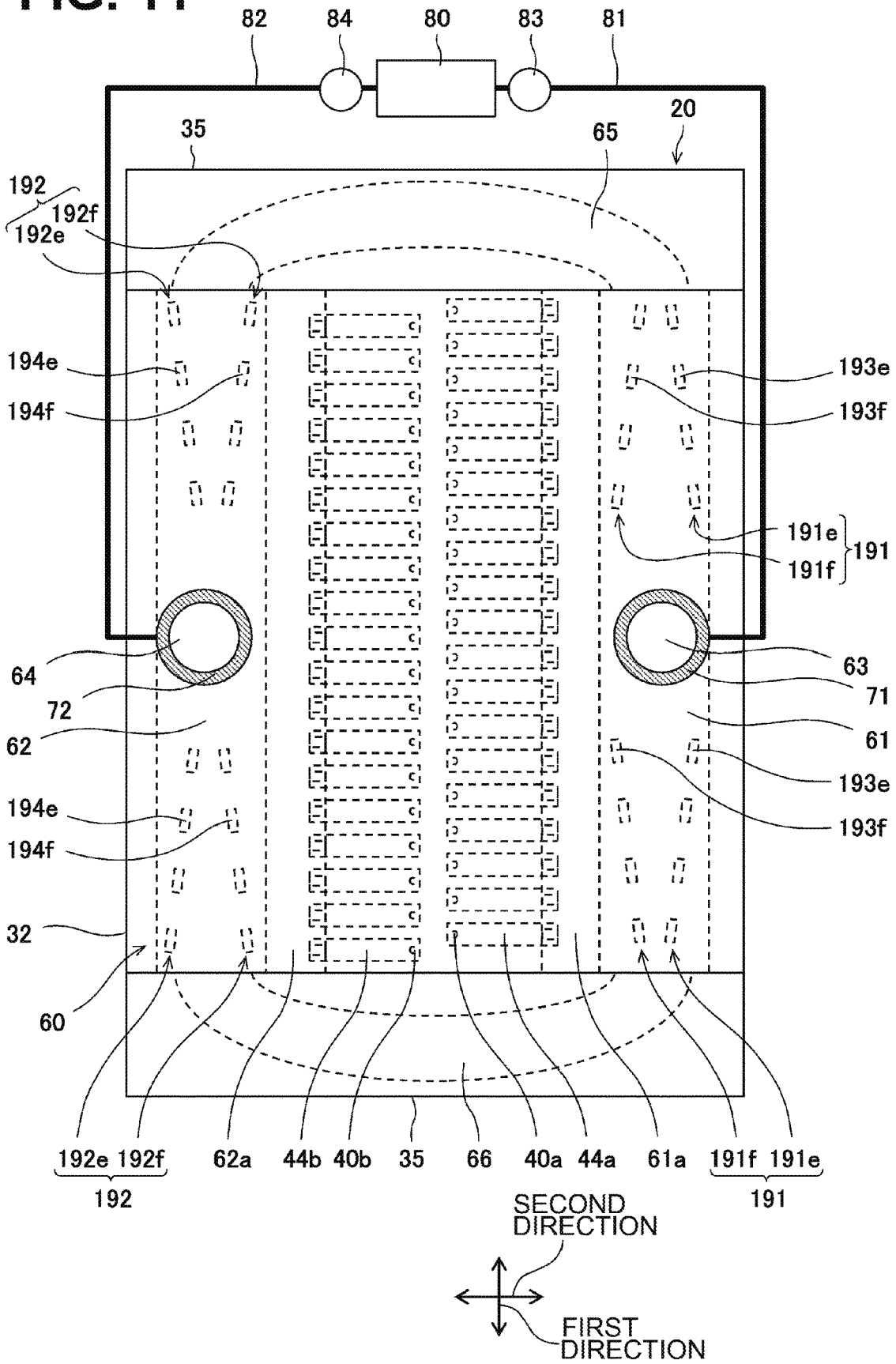
FIG. 11 is a schematic top view of a liquid ejection head according to a fourth modification of the third illustrative embodiment.

In a head 20 according to a fourth modification of the third illustrative embodiment, as shown in FIG. 11, first protruding members 191 may each extend from the first opening 61 toward the first communication passage 65 or the second communication passage 66 so as to be closer to a center of the first channel 61 in a direction orthogonal to an extending direction of the first channel 61. The elements other than the above-described elements are similar, in structure, function, and effect, to those of the third illustrative embodiment and will not be described repeatedly.

Specifically, the first protruding members 191 include two pairs of first protruding members 191*e* and 191*f*. One pair of first protruding members 191*e* and 191*f* is located between the first opening 63 and the first communication passage 65 in the first direction. The other pair of first protruding members 191*e* and 191*f* is located between the first opening 63 and the second communication passage 66 in the first direction.

When viewed from above, each pair of first protruding members 191*e* and 191*f* is arranged in a V shape in a direction (including the first direction and the second direction) orthogonal to a vertical direction. The first protruding members 191*e* and 191*f* are spaced from each other in the second direction such that a distance therebetween increases from the first opening 63 toward the communication passage 65 or 66.

The first protruding member 191*e* includes a plurality of first protrusions 193*e* arranged at intervals on a straight line inclined in a direction between the first direction and the second direction. The first protruding member 191*f* includes a plurality of first protrusions 193*f* arranged at intervals on a straight line inclined in a direction between the first direction and the second direction. The first protrusions 193*e* and the first protrusions 193*f* have the same size and shape and are arranged side by side in the second direction.

The first protruding members 191 each extend from the first opening 63 toward the first communication passage 65 or the second communication passage 66 so as to be closer to a center of the first channel 61 in the second direction. Fluid flows at a higher velocity at a portion closer to the center. Thus, air bubbles are collected, along the first protruding members 191, toward the center with a high velocity and are efficiently discharged from the first channel 61.

Fifth Modification

In a head 20 according to a fifth modification of the third illustrative embodiment, as shown in FIG. 11, second protruding members 192 may each extend from the second opening 64 toward the first communication passage 65 or the second communication passage 66 so as to be farther from a center of the second channel 62 in a direction orthogonal to an extending direction of the second channel 62. The elements other than the above-described elements are similar, in structure, function, and effect, to those of the third illustrative embodiment and will not be described repeatedly.

Specifically, the second protruding members 192 include two pairs of second protruding members 192*e* and 192*f*. One pair of second protruding members 192*e* and 192*f* is located between the second opening 64 and the first communication passage 65 in the first direction. The other pair of second protruding members 192*e* and 192*f* is located between the second opening 64 and the second communication passage 66 in the first direction.

When viewed from above, each pair of second protruding members 192*e* and 192*f* is arranged in a V shape in a direction orthogonal to a vertical direction. The second protruding members 192*e* and 192*f* are spaced from each other in the second direction such that a distance therebetween decreases from the second opening 64 toward the communication passage 65 or 66.

The second protruding member 192*e* includes a plurality of second protrusions 194*e* arranged at intervals on a straight line inclined in a direction between the first direction and the second direction. The second protruding member 192*f* includes a plurality of second protrusions 194*f* arranged at intervals on a straight line inclined in a direction between the first direction and the second direction. The second protrusions 194*e* and the second protrusions 194*f* have the same size and shape and are arranged side by side in the second direction.

The second protruding members 192*e* and 192*f* each extend from the communication passage 65 or 66 toward the second opening 64 so as to be closer to a center of the second channel 62 in the second direction. Fluid flows at a higher velocity at a portion closer to the center. Thus, air bubbles entrained from the communication passages 65 and 66 into the second channel 62 flow, along the second protruding members 192, toward the second opening 64 and are collected toward the center with a high velocity. The air bubbles are efficiently discharged, via the second opening 64, from the second channel 62.

The structure of at least one of the first, second, and third modifications may be applied to the head 20 according to the third illustrative embodiment. The structure of the fourth modification may be applied to the head 20 according to the fifth modification.

While the disclosure has been described with reference to the specific embodiments thereof, these are merely examples, and various changes, arrangements and modifications may be applied therein without departing from the spirit and scope of the disclosure.

What is claimed is:

1. A liquid ejection head comprising:

a first nozzle hole array including a plurality of first nozzle holes arranged in a first direction;

a second nozzle hole array spaced from the first nozzle hole array in a second direction crossing the first direction, the second nozzle hole array including a plurality of second nozzle holes arranged in the first direction;

a plurality of first pressure chambers to which an ejection pressure is applied for liquid ejection from the first nozzle holes;

a plurality of second pressure chambers to which an ejection pressure is applied for liquid ejection from the second nozzle holes; and a manifold communicating with the plurality of first pressure chambers and the plurality of second pressure chambers, the manifold including:

a first channel communicating with the plurality of first pressure chambers;

a first opening which is located at the first channel and through which liquid enters from an exterior;

a second channel communicating with the plurality of second pressure chambers;

a second opening which is located at the second channel and through which liquid exits to the exterior;

a first communication passage communicating one end of the first channel with one end of the second channel; and a second communication passage communicating the other end of the first channel with the other end of the second channel.

2. The liquid ejection head according to claim 1, comprising a first unit and a second unit each including the first nozzle hole array, the second nozzle hole array, the plurality of the first pressure chambers, the plurality of second pressure chambers, and the manifold including the first opening connected to a common liquid tank, wherein the first unit and the second unit are arranged side by side in the second direction such that the first nozzle hole array and the second nozzle hole array of the first unit are parallel to the first nozzle hole array and the second nozzle hole array of the second unit.

3. The liquid ejection head according to claim 2, wherein in each of the first unit and the second unit, the first nozzle holes and the second nozzles holes are arranged alternately with each other in the first direction, and wherein the first nozzle holes and the second nozzle holes of the first unit, and the first nozzle holes and the second nozzle holes of the second unit are arranged at equal intervals in the first direction.

4. The liquid ejection head according to claim 1, wherein the first communication passage and the second communication passage are curved to protrude away from each other.

5. The liquid ejection had according to claim 1, wherein a cross-sectional area defined by the first communication passage to be orthogonal to an extending direction of the first communication passage is less than a cross-sectional area defined by the first channel to be orthogonal to an extending direction of the first channel, and wherein a cross-sectional area defined by the second communication passage to be orthogonal to an extending direction of the second communication passage is less than a cross-sectional area defined by the second channel to be orthogonal to an extending direction of the second channel.

6. The liquid ejection head according to claim 5, wherein each of the first channel and the second channel includes connection portions each connected to a corresponding one of the first communication passage and the second communication passage, each of the connection portions having a cross-sectional shape asymptotically similar to a cross-sectional shape of the corresponding one of the first communication passage and the second communication passage.

7. The liquid ejection head according to claim 1, wherein a center of the first opening is symmetrical to a center of the second opening relative to a center point of the manifold which surrounds the plurality of first pressure chambers and the plurality of second pressure chambers.

8. The liquid ejection head according to claim 1, wherein the first opening is located at a center of the first channel in an extending direction of the first channel, and wherein the second opening is located at a center of the second channel in an extending direction of the second channel.

9. The liquid ejection head according to claim 1, wherein a center of the first opening is located opposite to the plurality of first pressure chambers relative to a center of the first channel in a direction orthogonal to an extending direction of the first channel, and wherein a center of the second opening is located opposite to the plurality of second pressure chambers relative to a center of the second channel in a direction orthogonal to an extending direction of the second channel.

10. The liquid ejection head according to claim 1, further comprising a first port whose inner space communicates with the first opening, the first port increasing in diameter toward the first channel.

11. The liquid ejection head according to claim 1, further comprising a second port whose inner space communicates with the second opening, the second port decreasing in diameter in a direction away from the second channel.

12. The liquid ejection head according to claim 1, wherein the manifold includes, at an upper surface thereof, a protruding member protruding downward.

13. The liquid ejection head according to claim 12, wherein the protruding member extends in at least one of the first channel and the second channel in an extending direction of the at least one of the first channel and the second channel.

14. The liquid ejection head according to claim 12, wherein the protruding member extends from the first opening toward the first communication passage or the second communication passage so as to be closer to a center of the first channel in a direction orthogonal to an extending direction of the first channel.

15. The liquid ejection head according to claim 12, wherein the protruding member extends from the second opening toward the first communication passage or the second communication passage so as to be farther from a center of the second channel in a direction orthogonal to an extending direction of the second channel.

16. The liquid ejection head according to claim 12, wherein the protruding member includes a plurality of protrusions arranged at intervals.

* * * * *